US008372940B2

(12) United States Patent
Furukawa et al.

(10) Patent No.: US 8,372,940 B2
(45) Date of Patent: Feb. 12, 2013

(54) GOLF BALL

(75) Inventors: Mutsuhisa Furukawa, Fukuoka (JP); Ryo Mashita, Kobe (JP); Kazuyoshi Shiga, Kobe (JP); Takashi Sasaki, Kobe (JP); Mikio Yamada, Kobe (JP)

(73) Assignees: Mutsuhisa Furukawa, Fukuoka (JP); Sumitomo Rubber Industries Limited, Hyogo (JP); SRI Sports Limited, Hyogo (JP)

( * ) Notice: Subject to any disclaimer, the term of this patent is extended or adjusted under 35 U.S.C. 154(b) by 303 days.

(21) Appl. No.: 12/821,770

(22) Filed: Jun. 23, 2010

(65) Prior Publication Data

US 2010/0331118 A1 Dec. 30, 2010

(30) Foreign Application Priority Data

Jun. 30, 2009 (JP) ..... 2009-156353

(51) Int. Cl.
*A63B 37/12* (2006.01)
*A63B 37/00* (2006.01)
*C08G 18/44* (2006.01)

(52) U.S. Cl. ..... 528/76; 528/85; 473/378

(58) Field of Classification Search ..... None
See application file for complete search history.

(56) References Cited

U.S. PATENT DOCUMENTS

| | | | | |
|---|---|---|---|---|
| 4,248,432 | A * | 2/1981 | Hewitt et al. | 473/354 |
| 4,442,282 | A * | 4/1984 | Kolycheck | 528/83 |
| 6,660,824 | B2 * | 12/2003 | Yokota | 528/61 |
| 7,098,274 | B2 * | 8/2006 | Wu et al. | 525/467 |
| 7,388,066 | B2 | 6/2008 | Nagasawa et al. | |
| 2003/0073515 | A1 | 4/2003 | Yokota | |
| 2006/0128900 | A1 * | 6/2006 | Nanba et al. | 525/261 |
| 2007/0072701 | A1 * | 3/2007 | Nagasawa | 473/371 |
| 2007/0191139 | A1 | 8/2007 | Asakura et al. | |
| 2009/0023515 | A1 * | 1/2009 | Tarao | 473/371 |

FOREIGN PATENT DOCUMENTS

| | | | |
|---|---|---|---|
| JP | 2002-272878 | A | 9/2002 |
| JP | 2004-97581 | A | 4/2004 |
| JP | 2007-90065 | A | 4/2007 |
| JP | 2007-90069 | A | 4/2007 |
| JP | 2007-215613 | A | 8/2007 |
| JP | 2008-149059 | A | 7/2008 |

OTHER PUBLICATIONS

Japanese Notice of Reasons for Rejection for Application No. 2009-156353 dated Jun. 21, 2011.

Translation of Japanese Office Action dated Jun. 12, 2012 for corresponding Application No. 2009-156353.

* cited by examiner

*Primary Examiner* — David Buttner

(74) *Attorney, Agent, or Firm* — Birch, Stewart, Kolasch & Birch, LLP

(57) ABSTRACT

An object of the present invention is to improve the abrasion resistance of a golf ball that uses a polyurethane as a resin component for a cover. Another object of the present invention is to improve the shot feeling of a golf ball that uses a polyurethane as a resin component for a cover. The present invention provides a golf ball comprising a core; and a cover covering the core, wherein the cover contains a polyurethane elastomer as a resin component, and the polyurethane elastomer contains a polyol component and a polyisocyanate component and does not contain a chain extender.

18 Claims, 2 Drawing Sheets

GOLF BALL

FIELD OF THE INVENTION

The present invention relates to a golf ball that contains a polyurethane as a resin component for a cover, in particular, to a technique for improving the abrasion resistance of the cover of a golf ball.

DESCRIPTION OF THE RELATED ART

As a resin component constituting a cover of a golf ball, an ionomer resin or polyurethane is used. Covers containing an ionomer resin are widely used for their excellent repulsion, durability and processability. However, the problems have been pointed out that the shot feeling is poor because of the high rigidity and hardness and that the controllability is also poor because of the insufficient spin performance. On the other hand, polyurethane is used as the resin component constituting the cover, since the shot feeling and spin performance are improved compared with an ionomer resin.

As a golf ball that contains a polyurethane resin, for example, Japanese Patent Publication No. 2004-97581 A discloses a golf ball that contains a thermoplastic polyurethane resin that is obtained by reacting: a high-molecular-weight polyol (A) containing a high-molecular-weight polyol (A1) with a side-chain alkyl group and having a number average molecular weight of 500 to 10000; an organic diisocyanate (B); and a chain extender (C) having a molecular weight less than 500. The amount of the side-chain alkyl group in the thermoplastic polyurethane resin and the weight average molecular weight of the thermoplastic polyurethane resin are adjusted to be predetermined values (claim 4, paragraph 0039).

Japanese Patent Publication No. 2007-90069 A discloses a golf ball having a cover that is formed from a cover material that contains, as a base material, a thermoplastic polyurethane obtained by a polyurethane forming reaction of an organic polyisocyanate compound, a long-chain polyol, and a chain extender. The long-chain polyol contains a copolymerized polycarbonate polyol having a number average molecular weight of 400 to 4000, and the intrinsic viscosity of a DMF solution of the thermoplastic polyurethane and the intrinsic viscosity of a DMF solution with 0.05 mol/L n-butylamine of the thermoplastic polyurethane are within a predetermined range (claim 1, paragraph 0029).

Japanese Patent Publication No. 2008-149059 A discloses a golf ball having a cover that contains a product of a reaction for forming an amide bond. The amide bond is formed by a reaction between an isocyanate group at an end of the main chain of a polyurethane formed from a high-molecular-weight diol compound, a monomolecular chain extender, and a diisocyanate; and a carboxyl group of ethylene-(meth) acrylic acid copolymer resin (claim 3, paragraph 0035).

SUMMARY OF THE INVENTION

However, recently, with thinning of the cover of a golf ball (cover thinning) or improvement of a golf club (increase of resilience, decrease of spin, change of a groove shape on its face), further improvement is desired in cover performance of the golf ball. Thus, the abrasion resistance of conventional covers that contain polyurethane resins becomes unsatisfactory.

The present invention has been made in view of the above circumstances, and an object of the present invention is to further improve the abrasion resistance of a golf ball that contains a polyurethane as a resin component for a cover. Moreover, in a preferred embodiment of the present invention, another object is to further improve the shot feeling of a golf ball that contains a polyurethane as a resin component for a cover.

The present invention, which has achieved the above objects, provides a golf ball having a core and a cover covering the core. The cover contains a polyurethane elastomer as a resin component, and the polyurethane elastomer contains a polyol component and a polyisocyanate component and does not contain a chain extender.

In the polyurethane elastomer that does not contain a chain extender, each molecular chain is connected to adjacent molecular chains by weak hydrogen bonds throughout the molecular chain. Thus, deformation does not start unless a relatively great stress is applied. In addition, there is no portion where strong hydrogen bonds are formed as in hard segments, and hence the resistance against shear of the molecular chains is constant even when a deformation amount is large. It is thought that the use of such a polyurethane elastomer as a resin component for the cover improves durability against the high-speed impact such as hitting with a golf club, thereby improving the abrasion resistance.

According to the present invention, the golf ball with an excellent abrasion resistance is obtained in the golf ball containing a polyurethane as a resin component for a cover. In a preferable embodiment of the present invention, the golf ball with an excellent shot feeling is obtained in the golf ball containing a polyurethane as a resin component for a cover.

DESCRIPTION OF THE PREFERRED EMBODIMENT

The present invention includes a golf ball having a core and a cover covering the core and containing a polyurethane elastomer. The subject matter of the present invention resides in that the polyurethane elastomer contains, as a constituting component, a polyol component (for example, a high-molecular weight polyol) and a polyisocyanate component and does not substantially contain a chain extender.

Namely, the polyurethane elastomer is not limited, as long as it has a plurality of urethane bonds without having a chain extender as a constituting component. The polyurethane elastomer used in the present invention includes, for example, a product having urethane bonds formed in a molecule thereof by a reaction between the high-molecular weight polyol and the polyisocyanate component.

The reason why the polyurethane elastomer substantially not having a chain extender improves the abrasion resistance of the golf ball is not necessarily clear but considered as follows.

Figure 2:
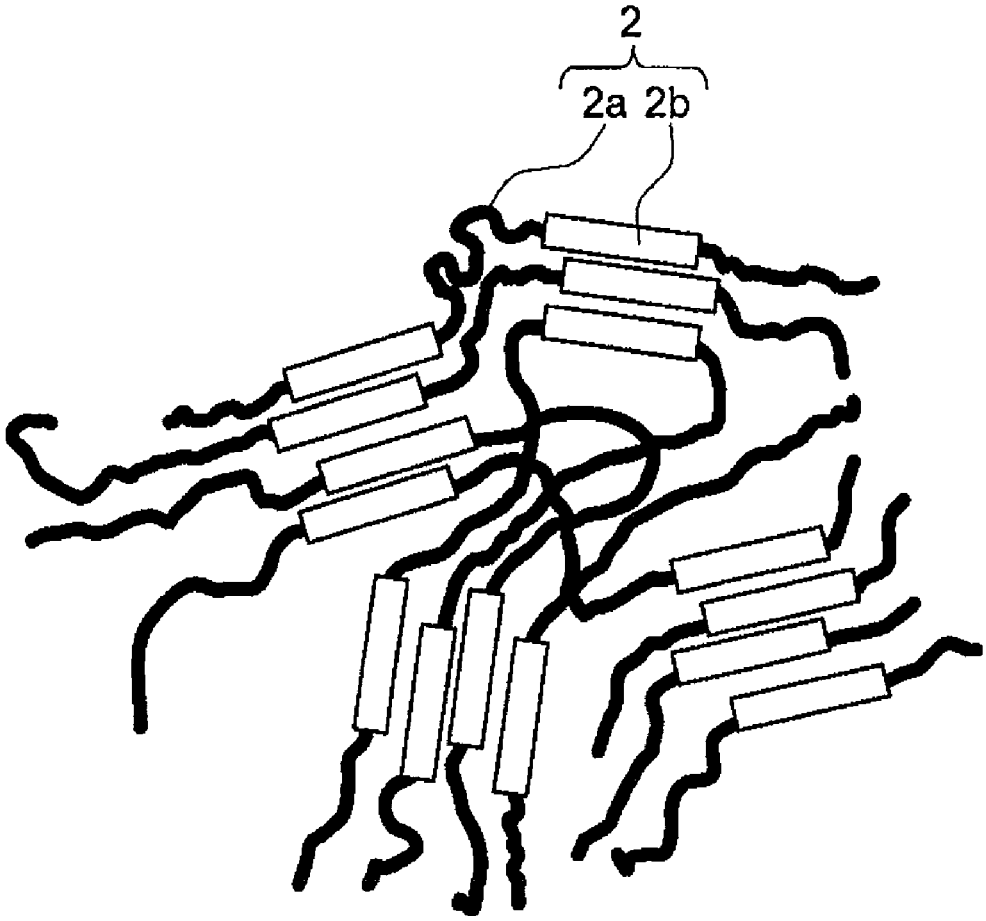
FIG. 2 is a view schematically showing a polyurethane having a chain extender.

Referring to FIG. 2, a polyurethane 2 containing a chain extender component has, in molecular chains thereof, soft segments 2*a* each consisting of a high-molecular-weight polyol component, and hard segments 2*b* each consisting of a polyisocyanate component and the chain extender component. In this case, in the resin, there are portions where the hard segments are connected to each other by strong hydrogen bonds, and there are portions where the soft segments are entangled with each other. When an external force is applied to such a polyurethane resin, the molecular chains can be sheared easily in the portions where the soft segments are entangled with each other, and thus deformation starts at a relatively low stress. Then, after the deformation amount becomes large and the soft segments are sheared substantially to their limit, the hydrogen bonds between the hard segments start to break, namely, the resistance becomes maximum. Thus, in the case of creep deformation, the performance of the polyurethane resin can be exhibited sufficiently. However, in the polyurethane resin having the hard segments as described above, the molecular chains does not tend to be sheared in the portions of the hard segments by a high-speed impact such as hitting with a golf club, and hence, the molecular chains break prior to break of the hydrogen bonds between the hard segments. Therefore, it is thought that abrasion is likely to occur from the hard segments.

Figure 1:
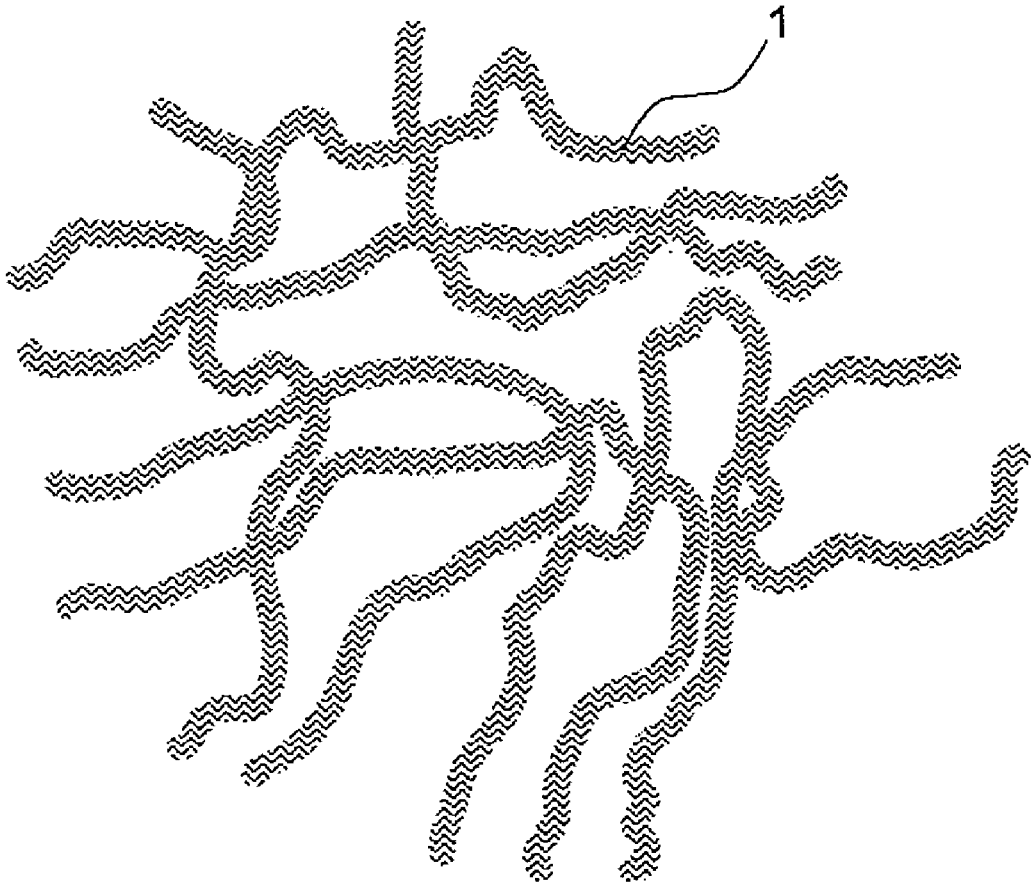
FIG. 1 is a view schematically showing a polyurethane without a chain extender.

On the other hand, referring to FIG. 1, a polyurethane elastomer 1 that does not contain a chain extender is so-called segment free, since a soft segment and a hard segment do not exist in molecular chains thereof. Each molecular chain is connected to adjacent molecular chains by weak hydrogen bonds throughout the molecular chain. When an external force is applied to such a polyurethane elastomer, deformation does not started unless a relatively great stress is applied thereto, because the molecular chains are entirely connected to each other through weak hydrogen bonds. In addition, even when a deformation amount gradually increases, relatively great resistance can be maintained until the molecular chains break, because: there is no portion, in the molecular chains, where strong hydrogen bonds are formed as in the hard segments; and the resistance against shear of the molecular chains is substantially constant. In such a segment-free polyurethane elastomer, the molecular chains are easily sheared entirely even by a high-speed impact such as hitting with a golf club, and the energy is consumed for breaking the weak hydrogen bonds throughout the molecular chains. Thus, it is thought that the molecular chains hardly break and hence the abrasion resistance improves.

As described above, the polyurethane elastomer used in the present invention substantially does not contain a chain extender as a constituting component, and characterized in segment-free. Herein, the chain extender is defined as a low-molecular weight polyol having a molecular weight of 300 or less or a low-molecular weight polyamine having a molecular weight of 300 or less.

Examples of the low-molecular weight polyol as the chain extender may include a diol such as ethylene glycol, diethylene glycol, triethylene glycol, propanediol (e.g., 1,2-propanediol, 1,3-propanediol, and 2-methyl-1,3-propanediol), dipropylene glycol, butanediol (e.g., 1,2-butanediol, 1,3-butanediol, 1,4-butanediol, 2,3-butanediol, and 2,3-dimethyl-2,3-butanediol), neopentyl glycol, pentanediol, hexanediol, heptanediol, octanediol, 1,4-cyclohexane dimethanol, an aniline type diol, and a bisphenol type diol (e.g., bisphenol A diol); a triol such as glycerin, trimethylol propane, and hexanetriol; a tetraol or a hexanol such as pentaerythritol and sorbitol. Example of the low-molecular polyamine includes an aliphatic polyamine such as ethylenediamine, propylenediamine, butylenediamine, and hexamethylenediamine, an alicyclic polyamine such as isophoronediamine, piperazine, and an aromatic polyamine such as phenylenediamine, tolylenediamine, diethyltoluenediamine, and dimethylthiotoluenediamine, and 4,4'-diaminodiphenyl methane.

In the present invention, if the content of the chain extender in the polyurethane elastomer is as follows, it is evaluated that the polyurethane elastomer substantially does not contain a chain extender. This is because the improved effect of the abrasion resistance by the segment free polyurethane elastomer is not impaired. The content of the chain extender in the polyurethane elastomer is 3 mass % or less, preferably 2.5 mass % or less, more preferably 2 mass % or less.

Whether or not the synthesized polyurethane elastomer contain the chain extender can be, for example, measured as follows. The polyurethane elastomer is subjected to a treatment with a DMF solution containing n-butylamine or a heat treatment to break urethane bonds in the polyurethane elastomer, and the resulting material is analyzed by gas chromatography, or other similar methods. A concentration of n-butylamine in the DMF solution preferably ranges from 0.01 mol/l to 0.25 mol/l, and is more preferably 0.05 mol/l. The heat treatment is preferably performed, for example, at a temperature ranging from 130° C. to 150° C. for a time period ranging from 2 hours to 4 hours.

The polyol component constituting the polyurethane is not limited, as long as it is a polyol different from the chain extender. The polyol preferably includes a high-molecular weight polyol. Such examples of the high-molecular weight polyol include a polyether polyol such as polyoxyethylene glycol (PEG), polyoxypropylene glycol (PPG), and polyoxytetramethylene glycol (PTMG); a polycarbonate polyol such as polyhexamethylene carbonate; and an acrylic polyol, a condensed polyester polyol such as polyethylene adipate (PEA), polybutylene adipate (PBA), and polyhexamethylene adipate (PHMA); a lactone polyester polyol such as poly-ε-caprolactone (PCL). The above polyols may be used alone or as a mixture of at least two of them.

A number average molecular weight of the high-molecular weight polyol is not particularly limited, and for example, it is preferably 400 or more, more preferably 800 or more, even more preferably 1,000 or more. Further, the number average molecular weight of the high-molecular weight polyol is preferably 10,000 or less, more preferably 8,000 or less. If the number average molecular weight of the high-molecular weight polyol falls within the above range, it is possible to adjust the rigidity of the polyurethane molecular chain at a higher degree, and the abrasion resistance and the shot feeling can be further improved. The number average molecular weight of the polyol component can be measured by Gel permeation Chromatography using two columns of TSK-GEL SUPREH 2500 (TOSOH Corporation) as a column, polystyrene as a standard material, and tetrahydrofuran as an eluate.

The high-molecular weight polyol preferably has a hydroxyl value of 500 mgKOH/g or less, more preferably 250 mgKOH/g or less, even more preferably 100 mgKOH/g or less. The hydroxyl value of the high-molecular weight polyol can be measured for example, by an acetylation method according to JIS K1557-1.

The polyol component (high-molecular weight polyol or the like) constituting the polyurethane elastomer preferably contains two or more polyols (for example, a hard polyol, and a soft polyol) that differently affect the rigidity of the molecular chain. Use of the two or more polyols as the polyol components facilitates adjusting the rigidity of the polyurethane molecular chain and also enables the adjustment of the resisting force against the shear of the molecular chain. Accordingly, the abrasion resistance and the shot feeling of the obtained golf ball can be controlled at the higher level.

As the hard polyol, a polyol having a group or a structure lowering the molecular motion can be used. Examples of the polyol having a group or a structure lowering the molecular motion include a polyol having one or at least two of the group consisting of a carbonate group, a ring structure such as a alicyclic structure or a aromatic ring structure, and an unsaturated bond such as a carbon carbon double bond or carbon carbon triple bond in a main chain.

The polyol having a carbonate group includes a poly(alkylene carbonate)diol such as a poly(hexamethylene carbonate) diol. The polyol having an alicyclic structure includes a polyol having a cyclohexyl group such as 1,4-cyclohexane dimethanol. The polyol having an aromatic ring structure includes a polyol having a phenylene group such as bisphenol based diol (especially, bisphenol A based diol). The polyol having an unsaturated group includes a polyol having an unsaturated carbon carbon double bond such as a polybutadiene glycol.

The hard polyol preferably includes a polycarbonate polyol having a carbonate group in a main chain thereof, more preferably a polycarbonate polyol having a carbonate group and a ring structure in a main chain thereof. The polycarbonate polyol having a carbonate group and a ring structure in a main chain thereof can be, for example, shown by the following formula (1).

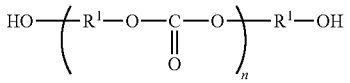

(1)

[In Formula (1), $R^1$ denotes a divalent hydrocarbon group having an alicyclic structure or an aromatic ring structure in the main chain, and n denotes a natural number.]

In the formula (1), the divalent hydrocarbon group having an alicyclic structure in a main chain includes, for example, a divalent residual group wherein two hydroxyl groups are removed from a diol such as 1,4-cyclohexanedimethanol, 1,4-cyclohexanediol, 1,4-cyclohexanediethanol, 1,1'-bicyclohexane-4,4'-diol. Among them, a divalent hydrocarbon group having 6 to 10 carbon atoms with a cyclohexyl group as the alicyclic structure is preferable.

The divalent hydrocarbon group having an aromatic ring structure in a main chain includes, for example, a divalent residual group wherein two hydroxyl group are removed from a diol such as bisphenol A, and bisphenol F. Among them, a divalent hydrocarbon group having 12 to 20 carbon atoms with a phenyl group or a phenylene group as an aromatic ring structure.

As a compound represented by the formula (1), for example, poly(1,4-cyclohexane dimethylene carbonate) glycol is exemplified.

On the other hand, as the soft polyol, a polyol not having a group or a structure that does not lower the molecular motion can be used. The soft polyol includes, for example, polyalkyleneetherglycols such as polyethyleneglycol, polytrimethyleneetherglycol, polytetramethyleneetherglycol, and polypentamethyleneetherglycol.

The soft polyol preferably includes a polyetherpolyol, for example, represented by the following formula (2).

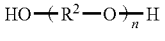

(2)

[In Formula (2), $R^2$ denotes a divalent saturated hydrocarbon group, and n denotes a natural number.]

In the above formula (2), the divalent hydrocarbon group includes, for example, divalent residual groups where two hydroxyl groups are removed from linear diols such as 1,3-propanediol, 1,4-butanediol, 1,5-pentandiol, 1,6-hexanediol, or branched diols such as propyleneglycol, 1,2-butanediol, 1,3-butanediol, 2,3-butanediol, 2-methyl-1,3-propanediol, 1,2-pentanediol, 1,3-pentanediol, 1,4-pentanediol, 2,3-pentanediol, 2,4-pentaediol, 2-methyl-1,3-butanediol, 2-methyl-1,4-butanediol. Among them, divalent saturated hydrocarbon groups having 3 to 6 carbon atoms are preferable, and divalent saturated hydrocarbon groups having a side chain are more preferable.

The compound represented by the above formula (2) includes, for example, a poly(oxypropylene)glycol.

The mass ratio (hard polyol/soft polyol) of the hard polyol to the soft polyol is preferably 3/7 or more, more preferably 4/6 or more, and is preferably 7/3 or less, more preferably 6/4 or less, even more preferably 5/5 or less. If the mass ratio of the hard polyol to the soft polyol falls within the above range, the abrasion resistance of the obtained golf ball is further improved. Especially, if the mass ratio is 5/5 or less, the shot feeling of the obtained golf ball is also improved.

Examples of the polyisocyanate component include an aromatic polyisocyanate such as 2,4-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODD, xylylene diisocyanate (XDI), tetramethylxylylenediisocyanate (TMXDI), para-phenylene diisocyanate (PPDI); an alicyclic polyisocyanate or aliphatic polyisocyanate such as 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), and norbornene diisocyanate (NBDI). These may be used either alone or as a mixture of at least two of them.

In view of improving the abrasion-resistance, the aromatic polyisocyanate is preferably used as the polyisocyanate component of the polyurethane. Use of the aromatic polyisocyanate improves the mechanical property of the obtained polyurethane and provides the cover with the excellent abrasion-resistance. In addition, in view of improving the weather resistance, as the polyisocyanate component of the polyurethane, a non-yellowing type polyisocyanate such as TMXDI, XDI, HDI, $H_6$XDI, IPDI, $H_{12}$MDI and NBDI is preferably used. More preferably, 4,4'-dicyclohexylmethane diisocyanate ($H_{12}$MDI) is used. Since 4,4'-dicyclohexylmethane diisocyanate ($H_{12}$MDI) has a rigid structure, the mechanical property of the resulting polyurethane is improved, and thus the cover which is excellent in abrasion-resistance can be obtained.

The polyurethane elastomer can be prepared by appropriately using the polyol component and the polyisocyanate component. The method for synthesizing the polyurethane includes, for example, a one-shot method of reacting the polyisocyanate component and the polyol component at once.

In the case of synthesizing the polyurethane elastomer by the one-shot method, the charging ratio of the polyisocyanate component to the polyol component is, preferably 1.00 or larger, more preferably 1.02 or larger, and even more preferably 1.04 or larger, and is preferably 1.10 or smaller, more preferably 1.08 or smaller, and even more preferably 1.06 or smaller in a molar ratio (NCO/OH) of the isocyanate group (NCO) contained in the polyisocyanate component to the hydroxyl group (OH) contained in the polyol component.

The temperature at which the urethane reaction is performed is preferably 70° C. or higher, more preferably 75° C. or higher, and is preferably 90° C. or lower, more preferably 85° C. or lower. The reaction time for the urethane reaction is preferably 10 hours or longer, more preferably 12 hours or longer, and even more preferably 15 hours or longer, and is preferably 30 hours or shorter, more preferably 25 hours or shorter, and even more preferably 20 hours or shorter.

In synthesizing the polyurethane, a known catalyst may be used as long as it does not impair the effect of the present invention. Examples of the catalyst include a monoamine such as triethylamine, and N,N-dimethylcyclohexylamine; a polyamine such as N,N,N',N'-tetramethylethylenediamine, and N,N,N',N",N"-pentamethyldiethylenetriamine; a cyclic diamine such as 1,8-diazabicyclo-[5.4.0]-7-undecene (DBU), triethylenediamine; a tin-based catalyst such as dibutyl tin dilaurylate, and dibutyl tin diacetate. Each of these catalysts may be used solely, or two or more of these catalysts may be used in combination. Among these catalysts, a tin-based catalyst such as dibutyl tin dilaurylate, and dibutyl tin diacetate are preferable, and in particular, dibutyl tin dilaurylate is preferably used.

The cover of the present invention may contain other resin components in addition to the polyurethane elastomer as a resin component, as long as it does not impair the effect of the present invention. In the case that the other resin component is used as the resin component for the cover of the present invention, the resin component preferably contains the polyurethane elastomer in amount of 50 mass % or higher, more preferably 60 mass % or higher, and even more preferably 70 mass % or higher. Further, it is also preferable that the resin component essentially consists of the polyurethane elastomer.

Examples of the other resin component include an ionomer resin, a thermoplastic elastomer, or the like. Examples of the ionomer resin include one prepared by neutralizing at least a part of carboxyl groups in a copolymer, composed of ethylene and (meth)acrylic acid with a metal ion; one prepared by neutralizing at least a part of carboxyl groups in a terpolymer composed of ethylene, (meth)acrylic acid, and (meth)acrylic acid ester with a metal ion; or a mixture of these two.

Examples of the metal ion are; monovalent metal ions such as sodium, potassium, and lithium; divalent metal ions such as magnesium, calcium, zinc, barium, and cadmium; trivalent metal ions such as aluminum, or other metal ions such as tin and zirconium. In particular, sodium ion, zinc ion, and magnesium ion are preferably used in view of the resilience and durability of the golf ball. Examples of the (meth)acrylic acid ester include methyl ester, ethyl ester, propyl ester, n-butyl ester, isobutyl ester of (meth)acrylic acid.

Specific examples of the ionomer resin include "Himilan (registered trade mark)" available from MITSUI-DUPONT POLYCHEMICAL CO., LTD, "Surlyn (registered trade mark)", "HPF1000" or "HPF2000" available from DUPONT CO, and "Iotek (registered trade mark)" available from Exxon Mobil Co.

Specific examples of the thermoplastic elastomer includes a thermoplastic polyamide elastomer having a commercial name of "PEBAX (registered trade mark)" available from ARKEMA Inc; a thermoplastic polyester elastomer having a commercial name of "HYTREL" available from DU PONT-TORAY Co.; a thermoplastic polyester elastomer having a commercial name of "Primalloy (registered trade name)" available from Mitsubishi Chemical Co; a thermoplastic polystyrene elastomer having a commercial name of "Rabalon (registered trade name)" available from Mitsubishi Chemical Co; an ethylene-methacrylic acid copolymer having a commercial name of "Nucrel (registered trade mark)" available from MITSUI-DUPONT POLYCHEMICAL CO., LTD; an ethylene-methacrylic acid copolymer having a commercial name of "PRIMCOR (registered trade mark)" available from DOW CHEMICAL CO., LTD; a thermoplastic polyurethane elastomer having a commercial name of "Elastollan (registered trade mark)" available from BASF Japan Co. or the like.

The cover of the golf ball of the present invention may contain a pigment component such as a white pigment (for example, titanium oxide), a blue pigment, and a red pigment, a gravity adjusting agent such as zinc oxide, calcium carbonate and barium sulfate, a dispersant, an antioxidant, an ultraviolet absorber, a light stabilizer, a fluorescent material or a fluorescent brightener, as long as the cover performance is not damaged.

The content of the white pigment is preferably 0.5 part by mass or more, more preferably 1 part by mass or more, and preferably 10 parts by mass or less, more preferably 8 parts by mass or less based on 100 parts by mass of the resin component constituting the cover. The white pigment in an amount of 0.5 part by mass or more can impart opacity to the cover, while the white pigment in an amount of 10 parts by mass or less imparts the better durability to the resulting cover.

The cover of the golf ball of the present invention is formed by molding the cover composition containing the above polyurethane elastomer. An embodiment for molding a cover is not particularly limited, and includes an embodiment which comprises injection molding the cover composition directly onto the core, or an embodiment which comprises molding the cover composition into a hollow-shell, covering the core with a plurality of the hollow-shells and subjecting the core with a plurality of the hollow shells to the compression-molding (preferably an embodiment which comprises molding the cover composition into a half hollow-shell, covering the core with the two half hollow-shells, and subjecting the core with the two half hollow-shells to the compression-molding).

Molding of the half shell can be performed by either compression molding method or injection molding method, and the compression molding method is preferred. The compression-molding of the cover composition into half shell can be carried out, for example, under a pressure of 1 MPa or more and 20 MPa or less at a temperature of −20° C. or more and 70° C. or less relative to the flow beginning temperature of the cover composition. By performing the molding under the above conditions, a half shell having a uniform thickness can be formed. Examples of a method for molding the cover using half shells include covering the core with two half shells and integrating them by compression molding. The integration of half shells into the cover can be carried out, for example, under a pressure of 0.5 MPa or more and 25 MPa or less at a temperature of −20° C. or more and 70° C. or less relative to the flow beginning temperature of the cover composition. By performing the molding under the above conditions, a cover for a golf ball having a uniform thickness can be formed.

In the case of directly injection molding the cover composition onto the core, it is preferred to use upper and lower molds for forming a cover having a spherical cavity and pimples, wherein a part of the pimple also serves as a retractable hold pin. When forming the cover by injection molding, the hold pin is protruded to hold the core, and the cover composition which has been heated and melted is charged and then cooled to obtain a cover. For example, the cover composition heated at the temperature of 150° C. to 250° C. is charged into a mold held under the pressure of 9 MPa to 15 MPa for 0.1 to 5 seconds. After cooling for 10 to 60 seconds, the mold is opened and the golf ball with the cover molded is taken out from the mold.

When molding a cover, the concave portions called "dimple" are usually formed on the surface. After the cover is molded, the mold is opened and the golf ball body is taken out from the mold, and as necessary, the golf ball body is preferably subjected to surface treatment such as deburring, cleaning, and sandblast. If desired, a paint film or a mark may be formed. The paint film preferably has a thickness of, but not limited to, 5 μm or larger, more preferably 7 μm or larger, and preferably has a thickness of 25 μm or smaller, more preferably 18 μm or smaller. This is because if the thickness is smaller than 5 μm, the paint film is easy to wear off due to continued use of the golf ball, and if the total thickness is larger than 25 μm, the effect of the dimples is reduced, resulting in deteriorating flying performance of the golf ball.

The thickness of the cover of the golf ball of the present invention is not particularly limited; however, it is preferably 1.0 mm or less, more preferably 0.6 mm or less, and even more preferably 0.5 mm or less. If the thickness of the cover is 1.0 mm or less, the resilience of the obtained golf ball becomes better because the core has a relatively large diameter. The lower limit of the thickness of the cover is preferably, but not limited to, 0.3 mm. If the thickness of the cover is 0.3 mm or more, molding the cover becomes easy. Herein, the thickness is measured at the portion where the dimples are not formed, that is the thickness just under the land. The thicknesses measured at least 4 portions are averaged.

The cover preferably has the slab hardness of 20 or more, more preferably 23 or more, and even more preferably 25 or more, and preferably has the slab hardness of 50 or less, more preferably 48 or less, even more preferably 46 or less in Shore D hardness. If the slab hardness of the cover is 20 or more, the repulsion property of the golf ball is improved, resulting in a greater flight distance, while if the cover hardness is 50 or less, the durability of the obtained golf ball is further improved. The slab hardness of the cover is a hardness measured in a sheet form of the cover composition, by a measuring method described later.

The golf ball of the present invention has no limitation on the construction thereof, as long as it has a core and a cover covering the core. Various cores can be employed. The core of the golf ball of the present invention includes a single-layered core, a two-layered core consisting of a center and a single-layered intermediate layer covering the core, a multi-layered core consisting of a center and multi-piece or multi-layer (especially, at least three-piece or three-layer) of intermediate layers covering the center; or a wound core. The golf ball using a single-layered core, two-layered core, multi-layered core, and a wound core are called, two-piece golf ball, three-piece golf ball, multi-piece golf ball, and a wound golf ball, respectively. The present invention can be preferably applied to anyone of the above golf balls. Preferable cores are a single-layered core, two-layered core, or a multi-layered core.

The core preferably has a spherical shape. If the core does not have a spherical shape, the cover does not have a uniform thickness. As a result, there exist some portions where the performance of the cover is lowered. On the other hand, the center generally has the spherical shape, but the center may be provided with a rib on the surface thereof so that the surface of the spherical center is divided by the ribs, preferably the surface of the spherical center is evenly divided by the ribs. In one embodiment, the ribs are preferably formed on the surface of the spherical center in an integrated manner, and in another embodiment, the ribs are formed as an intermediate layer on the surface of the spherical center.

The ribs are preferably formed along an equatorial line and meridians that evenly divide the surface of the spherical center, if the spherical center is assumed as the earth. For example, if the surface of the spherical center is evenly divided into 8, the ribs are formed along the equatorial line, any meridian as a standard, and meridians at the longitude 90 degrees east, longitude 90 degrees west, and the longitude 180 degrees east (west), assuming that the meridian as the standard is at longitude 0 degree. If the ribs are formed, the depressed portion divided by the ribs are preferably filled with a plurality of intermediate layers or with a single-layered intermediate layer that fills each of the depressed portions to make a core in the spherical shape. The shape of the ribs, without limitation, includes an arc or an almost arc (for example, a part of the arc is removed to obtain a flat surface at the cross or orthogonal portions thereof).

The core or the center of the golf ball of the present invention, is preferably molded by heat-pressing a conventional rubber composition (hereinafter, sometimes merely referred to as "core rubber composition") containing, for example, a base rubber, a crosslinking initiator, a co-crosslinking agent, and where necessary a filler.

As the base rubber, a natural rubber or a synthetic rubber can be used. Such examples include a polybutadiene rubber, a natural rubber, a polyisoprene rubber, a styrene polybutadiene rubber, and ethylene-propylene-diene terpolymer (EPDM). Among them, typically preferred is the high cis-polybutadiene having cis-1,4 bond in a proportion of 40% or more, more preferably 70% or more, even more preferably 90% or more in view of its superior repulsion property.

The crosslinking initiator is blended to crosslink the base rubber component. As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. An amount of the crosslinking initiator to be blended in the rubber composition is preferably 0.2 part by mass or more, more preferably 0.3 part by mass or more, and is preferably 3 parts by mass or less, more preferably 2 parts by mass or less based on 100 parts by mass of the base rubber. If the amount is 0.2 part by mass or more, the core does not become too soft, and the resilience becomes better, and if the amount is 3 parts by mass or less, a desired hardness is obtained without using the excessive amount of co-crosslinking agent, which provides the better resilience.

The co-crosslinking agent is not particularly limited as long as it has the effect of crosslinking a rubber molecule by graft polymerization to a base rubber molecular chain; for example, α,β-unsaturated carboxylic acid having 3 to 8 carbon atoms or a metal salt thereof, more preferably acrylic acid, methacrylic acid or a metal salt thereof may be used. As the metal constituting the metal salt, for example, zinc, magnesium, calcium, aluminum and sodium may be used, and among them, zinc is preferred because it provides high resilience. The amount of the co-crosslinking agent to be used is preferably 10 parts or more, more preferably 20 parts or more, and is preferably 50 parts or less, more preferably 40 parts or less based on 100 parts of the base rubber by mass. If the amount of the co-crosslinking agent to be used is 10 parts by mass or more, the desired hardness is obtained without using the excessive amount of the crosslinking initiator, which imparts the better resilience to the core. On the other hand, if the amount of the co-crosslinking agent to be used is 50 parts by mass or less, the core does not become too hard, so that the shot feeling may become better.

The filler contained in the core rubber composition is mainly blended as a gravity adjusting agent in order to adjust the specific gravity of the golf ball obtained as the final product in the range of 1.0 to 1.5, and may be blended as required. Examples of the filler include an inorganic filler such as zinc oxide, barium sulfate, calcium carbonate, magnesium oxide, tungsten powder, and molybdenum powder. The amount of the filler to be blended in the rubber composition is preferably 2 parts or more, more preferably 3 parts or more, and preferably 50 parts or less, more preferably 35 parts or less based on 100 parts of the base rubber by mass. If the amount of the filler to be blended is 2 parts by mass or more, it becomes easy to adjust the weight, while if it is 50 parts by mass or less, the weight ratio of the rubber component in the whole core becomes large and the resilience is improved.

As the core rubber composition, an organic sulfur compound, an antioxidant or a peptizing agent may be blended appropriately. As the organic sulfur compound, a diphenyl disulfide or a derivative thereof may be preferably used. Examples of the diphenyl disulfide or the derivative thereof include diphenyl disulfide; a mono-substituted diphenyl disulfide such as bis (4-chlorophenyl) disulfide, bis (3-chlorophenyl) disulfide, bis (4-bromophenyl) disulfide, bis (3-bromophenyl) disulfide, bis (4-fluorophenyl) disulfide, bis (4-iodophenyl) disulfide and bis (4-cyanophenyl) disulfide; a di-substituted diphenyl disulfide such as bis (2,5-dichlorophenyl) disulfide, bis (3,5-dichlorophenyl) disulfide, bis (2,6-dichlorophenyl) disulfide, bis (2,5-dibromophenyl) disulfide, bis (3,5-dibromophenyl) disulfide, bis (2-chloro-5-bromophenyl) disulfide, and bis (2-cyano-5-bromophenyl) disulfide; a tri-substituted diphenyl disulfide such as bis (2,4,6-trichlorophenyl) disulfide, and bis (2-cyano-4-chloro-6-bromophenyl) disulfide; a tetra-substituted diphenyl disulfide such as bis (2,3,5,6-tetra chlorophenyl) disulfide; a penta-substituted diphenyl disulfide such as bis (2,3,4,5,6-pentachlorophenyl) disulfide and bis (2,3,4,5,6-pentabromophenyl) disulfide. These diphenyl disulfides or the derivative thereof can enhance resilience by having some influence on the state of vulcanization of vulcanized rubber. Among them, diphenyl disulfide and bis (pentabromophenyl) disulfide are preferably used since a golf ball having particularly high resilience can be obtained. The amount of the diphenyl disulfide or the derivative thereof to be blended is preferably 0.1 part by mass or more, more preferably 0.3 part by mass or more, and preferably 5.0 parts by mass or less, more preferably 3.0 parts by mass or less relative to 100 parts by mass of the base rubber.

The amount of the antioxidant to be blended is preferably 0.1 part or more and is preferably 1 part or less based on 100 parts of the base rubber by mass. Further, the amount of the peptizing agent is preferably 0.1 part or more and is preferably 5 parts or less based on 100 parts of the base rubber by mass.

The conditions for press-molding the rubber composition should be determined depending on the rubber composition. The press-molding is preferably carried out for 10 to 60 minutes at the temperature of 130 to 200° C. Alternatively, the press-molding is preferably carried out in a two-step heating, for example, for 20 to 40 minutes at the temperature of 130 to 150° C., and continuously for 5 to 15 minutes at the temperature of 160 to 180° C.

The core used in the golf ball of the present invention preferably has a diameter of 39.0 mm or larger, more preferably 39.5 mm or larger, and even more preferably 40.8 mm or larger, and preferably has a diameter of 42.2 mm or smaller, more preferably 42.0 mm or smaller, and even more preferably 41.8 mm or smaller. If the diameter of the core is 39.0 mm or more, the repulsion of the obtained golf ball is further improved. On the other hand, if the diameter of the core is 42.2 mm or less, the cover becomes relatively thick and the protection effect of the cover is further improved.

In the case that the core has a diameter of from 39.0 mm to 42.2 mm, the compression deformation amount (deformation amount along the shrinkage direction) of the core when applying a load from 98 N as an initial load to 1275 N as a final load is preferably 2.50 mm or more, more preferably 2.60 mm or more, and is preferably 3.20 mm or less, and more preferably 3.10 mm or less. If the above deformation amount is 2.50 mm or more, the core does not become too hard, resulting in the better shot feeling of the golf ball, while if the above deformation amount is 3.20 mm or less, the core does not become too soft, and the repulsion of the core is further improved.

In a preferable embodiment, the core has a hardness difference between the center and the surface. The difference between the surface hardness and the center hardness is preferably 10 or more, more preferably 12 or more, and is preferably 40 or less, more preferably 35 or less, and even more preferably 30 or less in JIS-C hardness. If the hardness difference is 10 or more, the shot feeling becomes better, while if the hardness difference is 40 or less, the durability becomes better. The hardness difference of the core can be adjusted by properly selecting the heat molding conditions of the core.

The surface hardness of the core is preferably 65 or more, more preferably 70 or more, even more preferably 72 or more, and is preferably 100 or less in JIS-C hardness. If the surface hardness of the core is 65 or more in JIS-C hardness, the core does not become too soft and the repulsion property becomes better, resulting in the greater flight distance. On the other hand, if the surface hardness of the core is 100 or less, the core does not become too hard and the shot feeling becomes better.

The center hardness of the core is preferably 45 or more, more preferably 50 or more, and is preferably 70 or less, and more preferably 65 or less in JIS-C hardness. If the center hardness of the core is 45 or more, the core does not become too soft and the durability becomes better, while if the center hardness of the core is 70 or less, the core does not become too hard and the shot feeling becomes better.

In the case that the core of the golf ball of the present invention is a two-layered core or a multi-layered core, the diameter of the center is preferably 30 mm or more, more preferably 32 mm or more, and is preferably 41 mm or less, more preferably 40.5 mm or less. If the diameter of the center is 30 mm or more, the intermediate layer or the cover is not too thick, and thus the repulsion becomes better. On the other hand, if the diameter of the center is 41 mm or less, the intermediate layer or the cover is not too thin, the intermediate layer or the cover functions better.

Examples of the resin components for the intermediate layer are an ionomer resin and thermoplastic elastomers exemplified as the resin components for the cover. The intermediate layer may further contain a gravity adjusting agent such as barium sulfate, tungsten or the like, an antioxidant, and a pigment or the like.

The intermediate layer of the golf ball of the present invention preferably has a slab hardness of 50 or larger, more preferably 55 or larger, and even more preferably 60 or larger, and preferably has a slab hardness of 75 or smaller, more preferably 72 or smaller, and even more preferably 70 or smaller in Shore D hardness. The intermediate layer having the slab hardness of 50 or more in shore D hardness improves the repulsion of the obtained golf ball, resulting in the greater flight distance. On the other hand, the intermediate layer having the slab hardness of 75 or less in shore D hardness provides an excellent shot feeling as well as suppresses the lowering of the durability by being hit repeatedly. Herein, the slab hardness of the intermediate layer is the measured hardness of the intermediate layer composition in the form of a sheet, and is measured by a later-described measuring method.

An embodiment for molding the intermediate layer is not particularly limited, and includes an embodiment which comprises injection molding the intermediate layer composition directly onto the center, or an embodiment which comprises molding the intermediate layer composition into a half hollow-shell, covering the center with the two hollow-shells and subjecting the center with the two hollow shells to the compression-molding.

The thickness of the intermediate layer is preferably 0.3 mm or more, more preferably 0.4 mm or more, and even more preferably 0.5 mm or more, and is preferably 2.5 mm or less, more preferably 2.3 mm or less, and even more preferably 2.0 mm or less. By making the thickness of the intermediate layer to be 0.3 mm or more, the durability of the obtained golf ball is further improved. In addition, by causing the thickness of the intermediate layer to be 2.5 mm or less, the lowering of the repulsion of the obtained golf ball can be suppressed.

When preparing a wound golf ball in the present invention, a wound core may be used as the core. In that case, for example, a wound core comprising a center formed by curing the above rubber composition for the core and a rubber thread layer which is formed by winding a rubber thread around the center in an elongated state can be used. In the present invention, the rubber thread, which is conventionally used for winding around the center, can be adopted for winding around the center. The rubber thread, for example, is obtained by vulcanizing a rubber composition including a natural rubber, or a mixture of a natural rubber and a synthetic polyisoprene, a sulfur, a vulcanization auxiliary agent, a vulcanization accelerator, and an antioxidant. The rubber thread is wound around the center in elongation of about 10 times length to form the wound core.

EXAMPLES

The following examples illustrate the present invention, however these examples are intended to illustrate the invention and are not to be construed to limit the scope of the present invention. Many variations and modifications of such examples will exist without departing from the scope of the inventions. Such variations and modifications are intended to be within the scope of the invention.

[Evaluation Methods]

(1) Slab Hardness (Shore D Hardness) of the Intermediate Layer Composition and the Cover Composition Sheets having a thickness of about 2 mm were prepared from the cover composition or the intermediate layer composition by hot press molding and preserved at the temperature of 23° C. for two weeks. Three or more of the sheets were stacked on one another to avoid being affected by the measuring substrate on which the sheets were placed, and the stack was subjected to the measurement using a P1 type auto hardness tester provided with the Shore D type spring hardness tester prescribed by ASTM-D2240, available from KOUBUNSHI KEIKI CO., LTD to obtain the respective slab hardness of the cover composition or the intermediate layer composition.

(2) Center Hardness and Surface Hardness of Core and Surface Hardness of Center (JIS-C Hardness)

The hardness measured at a surface part of the core and the center using a JIS-C type spring hardness tester specified by JIS K6301, were determined as the surface hardness of the core and the center, respectively. The JIS-C hardness obtained by cutting a spherical core into halves and measuring at the center of the cut surface was determined as the center hardness of the core.

(3) Compression Deformation Amount (mm)

A compression deformation amount of the center, the core, or the golf ball (a shrinking amount of the center, the core or the golf ball in the compression direction thereof), when applying a load from an initial load of 98 N to a final load of 1275 N, was measured.

(4) Abrasion-Resistance

A commercially available sand wedge was installed on a swing robot, and golf balls were hit at a head speed of 36 m/sec. Hit portion was evaluated and ranked into eight levels based on the following criteria. A smaller score indicates higher abrasion-resistance.

0 point: No hitting marks were observed.

1 point: Dot-like peeling (a maximum width is smaller than 3 mm) was observed.

2 point: Dot-like peeling (a maximum width is 3 mm or larger and smaller than 5 mm) was observed.

3 point: Line-like peeling (a maximum width is 5 mm or larger) was observed.

4 point: Clear line-like peeling (a maximum width is 5 mm or larger) was observed.

5 point: Deep and wide line-like peeling (a maximum width is 5 mm or larger) was observed.

6 point: Deep and wide peeling which was almost a plane was observed.

7 point: A part of the cover was scraped away as a plane.

(5) Shot Feeling

Actual hitting test was conducted by ten amateur golfers (high skilled golfers) using a putter. Feeling at the shot was evaluated by each person according to the following criteria. Major result of the evaluations of ten golfers was employed as the result of the golf ball.

E(Excellent): Impact is small and feeling is good.

G(Good): Normal feeling

P(Poor): Impact is large and feeling is poor (A) Preparation of Polyurethane without Containing a Chain Extender To have the compositions as shown in Table 2 (golf ball Nos. 1 to 11), polyol components (e.g. PCHC1000) were charged in vessels respectively, and mixed while being heated in the oil bath at the temperature of 110° C. to prepare mixed polyols. Subsequently, the mixed polyols were degassed under the reduced pressure, followed by adding polyisocyanate components (MDI) in such a molar ratio (NCO/OH) shown in table 2, and mixing for 5 minutes under a nitrogen gas flow. Then, the reaction liquid was degassed under the reduced pressure for 1 minute at the room temperature. After the degassing, the reaction liquid was spread in a container, kept at the temperature of 80° C. for 15 hours under a nitrogen gas atmosphere to carry out a urethane reaction, thereby obtaining polyurethanes without containing a chain extender.

(B) Preparation of Polyurethane Having a Chain Extender (B1) Preparation of Polyurethane Resin for the Golf Ball No. 12

To have the compositions as shown in Table 2, PCHC1000 and PPG1000 and BD were charged in a vessel, and mixed while being heated in the oil bath at the temperature of 110° C. to prepare mixed polyols. Subsequently, the mixed polyol was degassed under the reduced pressure, followed by adding polyisocyanate components (MDI) in such a molar ratio (NCO/OH) shown in Table 2, and mixing for 5 minutes under a nitrogen gas flow. Then, the reaction liquid was degassed under the reduced pressure for 1 minute at the room temperature. After the degassing, the reaction liquid was spread in a container, kept at the temperature of 80° C. for 15 hours under a nitrogen gas atmosphere to carry out a urethane reaction, thereby obtaining the polyurethane containing a chain extender.

(B2) Preparation of Polyurethane Resin for the Golf Ball No. 13

To have the composition as shown in Table 2, first, PTMG1000 heated at the temperature of 80° C. was added to MDI heated at the temperature of 80° C. Then, dibutyl tin dilaurate (dibutyl tin dilaurate available from Aldrich, Inc.) of 0.005 mass % of the total amount of the other raw materials (MDI, PTMG1000, and BD) was added thereto. Then, the mixture was stirred at the temperature of 80° C. for 2 hours under a nitrogen gas flow. Under a nitrogen gas flow, BD heated at the temperature of 80° C. was added to the mixture, and the mixture was stirred at the temperature of 80° C. for 1 minute. Then, the reaction liquid was cooled, and degassed under the reduced pressure for 1 minute at the room temperature. After the degassing, the reaction liquid was spread in a container, kept at the temperature of 110° C. for 15 hours under a nitrogen gas atmosphere to carry out a urethane reaction, thereby obtaining the polyurethane containing a chain extender.

(C) Production of the Golf Ball (C1) Preparation of the Core

The center rubber composition having the formulation shown in Table 1 was kneaded and pressed in upper and lower molds, each having a hemispherical cavity, at a temperature of 170° C. for 15 minutes to obtain the center in a spherical shape. Next, the materials for the intermediate layer shown in Table 1 were mixed by a twin-screw kneading extruder to prepare an intermediate layer composition in the form of pellet. Extrusion was performed in the following conditions: screw diameter=45 mm; screw revolutions=200 rpm; and screw L/D=35. The mixtures were heated to a temperature ranging from 150° C. to 230° C. at a die position of the extruder. The obtained intermediate layer composition was injection molded on the center which had been obtained as described above, to prepare a core consisting of the center and the intermediate layer covering the center.

TABLE 1

| Core | | | |
|---|---|---|---|
| Center | Formulation | Polybutadiene rubber | 100 |
| | | Zinc acrylate | 35 |
| | | Zinc oxide | 5 |
| | | Diphenyl disulfide | 0.5 |
| | | Dicumyl peroxide | 1.0 |
| | | Diameter (mm) | 38.5 |

TABLE 1-continued

| Core | | | |
|---|---|---|---|
| Intermediate layer | Formulation | Himilan 1605 | 50 |
| | | Himilan AM7329 | 50 |
| | | Thickness (mm) | 1.6 |
| Core | Properties | Diameter (mm) | 41.7 |
| | | Surface hardness (JIS-C) | 98 |
| | | Center hardness (JIS-C) | 65 |
| | | Hardness difference (JIS-C) | 33 |
| | | Compression deformation amount (mm) | 2.55 |

Formulation: Parts by mass

Polybutadiene rubber: BR730 (high cis-polybutadiene) manufactured by JSR Corporation Zinc acrylate: ZNDA-90S manufactured by NIHON JYORYU KOGYO Co,. LTD.

Zinc oxide: Ginrei R manufactured by Toho-Zinc Co.

Dicumyl peroxide: Percumyl D manufactured by NOF Corporation

Diphenyl disulfide: manufactured by Sumitomo Seika Chemicals Company Limited

Himilan 1605: sodium ion neutralized ethylene-methacrylic acid copolymerized ionomer resin manufactured by MITSUI-DUPONT POLYCHEMICAL CO., LTD.

Himilan AM7329: zinc ion neutralized ethylene-methacrylic acid copolymerized ionomer resin manufactured by MITSUI-DUPONT POLYCHEMICAL CO., LTD.

(C2) Formulating of Cover Compositions

The cover materials shown in Table 2 were mixed by a twin-screw kneading extruder to prepare cover compositions in the form of pellet. Extrusion was performed in the following conditions: screw diameter=45 mm; screw revolutions=200 rpm; and screw L/D=35. The mixtures were heated to a temperature ranging from 150° C. to 230° C. at a die position of the extruder.

(C3) Molding of Half Shells

Compression molding of half shells were performed by, charging one pellet of the cover composition obtained as described above into each of depressed parts of lower molds for molding half shells, and applying pressure to mold half shells. Compression molding was performed at a temperature of 160° C. for 5 minutes under a molding pressure of 2.94 MPa.

(C4) Molding of the Cover

The cores obtained in (C1) were covered with the two half shells obtained in (C3) in a concentric manner, and the cover having a thickness of 0.5 mm was molded by compression molding. Compression molding was performed at a temperature of 150° C. for 2 minutes under a molding pressure of 9.8 MPa.

The surface of the obtained golf ball body was subjected to a sandblast treatment, and marking, and then clear paint was applied thereto and dried in an oven at a temperature of 40° C. to obtain a golf ball having a diameter of 42.7 mm and a weight of 45.3 g. Abrasion-resistance and shot feeling of the obtained golf ball were evaluated, and results thereof are shown in Table 2.

TABLE 2

| | | | | Golf ball No. | | | | | | | | | | | | |
|---|---|---|---|---|---|---|---|---|---|---|---|---|---|---|---|---|
| | | | | 1 | 2 | 3 | 4 | 5 | 6 | 7 | 8 | 9 | 10 | 11 | 12 | 13 |
| Cover | Resin component (parts) | Diisocyanate | MDI | 2.6 | 2.6 | 2.6 | 2.6 | 2.6 | 2.6 | 2.6 | 3.9 | 2 | 2.6 | 2 | 4 | 3.3 |
| | | Polycarbonate polyol | PCHC500 | — | — | — | — | — | — | — | 5 | — | — | — | — | — |
| | | | PCHC1000 | 2 | 3 | 4 | 5 | 6 | 7 | 8 | — | 5 | 5 | 5 | 5 | — |
| | | Polyether polyol | PPG1000 | 8 | 7 | 6 | 5 | 4 | 3 | 2 | 5 | — | — | — | 5 | — |
| | | | PPG2000 | — | — | — | — | — | — | — | — | 5 | — | — | — | — |
| | | | PTMG1000 | — | — | — | — | — | — | — | — | — | 5 | — | — | — |
| | | | PTMG2000 | — | — | — | — | — | — | — | — | — | — | 5 | — | 10 |
| | | Chain extender | BD | — | — | — | — | — | — | — | — | — | — | — | 0.5 | 0.5 |
| | | NCO/OH (molar ratio) | | 1.06 | 1.05 | 1.05 | 1.05 | 1.05 | 1.05 | 1.05 | 1.05 | 1.07 | 1.05 | 1.07 | 1.05 | 1.25 |
| | | Titanium oxide | | 3 | 3 | 3 | 3 | 3 | 3 | 3 | 3 | 3 | 3 | 3 | 3 | 3 |
| | | Slab hardness (Shore D) | | 20 | 24 | 29 | 32 | 39 | 55 | 63 | 62 | 30 | 28 | 28 | 63 | 34 |
| | | Cover thickness (mm) | | 0.5 | 0.5 | 0.5 | 0.5 | 0.5 | 0.5 | 0.5 | 0.5 | 0.5 | 0.5 | 0.5 | 0.5 | 0.5 |

TABLE 2-continued

| | | Golf ball No. | | | | | | | | | | | | |
|---|---|---|---|---|---|---|---|---|---|---|---|---|---|---|
| | | 1 | 2 | 3 | 4 | 5 | 6 | 7 | 8 | 9 | 10 | 11 | 12 | 13 |
| Evaluation | Abrasion-resistance | 4 | 3 | 2 | 1 | 2 | 3 | 4 | 4 | 3 | 2 | 3 | 5 | 6 |
| | Shot feeling | E | E | E | E | G | G | P | P | G | G | G | P | G |

Titanium oxide: parts with respect to 100 parts by mass of resin component

MDI: 4,4'-diphenylmethane diisocyanate, Sumidur 44S available from Sumika Bayer Urethane Co., Ltd.

PCHC500: Poly(1,4-cyclohexanedimethylenecarbonate) glycol having a number average molecular weight 500, "ETERNACOLL(registered trade name) UC-50" available from UBE Industries, LTD.

PCHC1000: Poly(1,4-cyclohexanedimethylenecarbonate) glycol having a number average molecular weight 1000, "ETERNACOLL(registered trade name) UC-100" available from UBE Industries, LTD.

PPG1000: Poly(oxypropylene)glycol having a number average molecular weight 1000, "EXCENOL (registered trade name) 1020" available from Asahi Glass Co., Ltd.

PPG2000: Poly(oxypropylene)glycol having a number average molecular weight 2000, "EXCENOL (registered trade name) 2020" available from Asahi Glass Co., Ltd.

PTMG1000: Polytetramethyleneetherglycol having a number average molecular weight 1000, "PTMG-1000SN" available from HODOGAYA CHEMICAL Co., Ltd.

PTMG2000: Polytetramethyleneetherglycol having a number average molecular weight 2000, "PTMG-2000SN" available from HODOGAYA CHEMICAL Co., Ltd.

BD: 1,4-butanediol available from WAKO Pure Chemicals, Industries, Ltd.

Golf balls No. 1 to 11 are the cases where the cover contains polyurethane without containing a chain extender as a resin component. Abrasion resistance was excellent in Golf ball Nos. 2 to 6, 8 to 11 where the mass ratio (hard polyol/soft polyol) of the hard polyol to the soft polyol falls within a range from 3/7 to 7/3. Among these, the shot feeling was also excellent in addition to the abrasion resistance in Golf ball Nos. 2 to 4 where the mass ratio (hard polyol/soft polyol) of the hard polyol to the soft polyol falls within a range from 3/7 to 5/5.

Golf ball Nos. 12 and 13 are the cases the polyurethane containing a chain extender was used, and showed poor abrasion resistance and shot feeling. Especially, the result of Golf ball No. 12 indicated that the abrasion resistance and shot feeling were not improved even if the mass ratio (hard polyol/soft polyol) of the hard polyol to the soft polyol is 5/5, if the polyurethane contains the chain extender.

The present invention is suitable for the improvement of the abrasion-resistance in a golf ball having a cover containing a polyurethane as a resin component. This application is based on Japanese Patent application No. 2009-156353 filed on Jun. 30, 2009, the contents of which are hereby incorporated by reference.

What is claimed is:

1. A golf ball comprising a core; and a cover covering the core, wherein the cover contains a polyurethane elastomer as a resin component, and the polyurethane elastomer contains a polyol component and a polyisocyanate component and does not contain a chain extender, wherein the polyol component contains a hard polyol; and a soft polyol that does not have any one of a carbonate group, a ring structure, and an unsaturated bond in a main chain thereof, and wherein the hard polyol is a polycarbonate polyol represented by the following Formula (1):

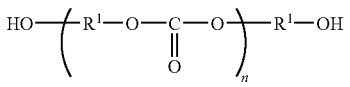

(1)

wherein $R^1$ denotes a divalent hydrocarbon group having an alicyclic structure or an aromatic ring structure in the main chain, and n denotes a natural number.

2. The golf ball according to claim 1, wherein the soft polyol is a polyether polyol.

3. The golf ball according to claim 1, wherein $R^1$ is a divalent hydrocarbon group having 6 to 10 carbon atoms with an alicyclic structure in a main chain thereof.

4. The golf ball according to claim 1, wherein $R^1$ is 1,4-cyclohexanedimethylene group.

5. The golf ball according to claim 1, wherein $R^1$ is a divalent hydrocarbon group having 12 to 20 carbon atoms with an aromatic ring in a main chain thereof.

6. The golf ball according to claim 1, wherein $R^1$ is a phenylene group.

7. The golf ball according to claim 1, wherein the soft polyol is a compound represented by the following Formula (2):

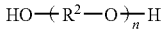

(2)

[In Formula (2), $R^2$ denotes a divalent saturated hydrocarbon group, and n denotes a natural number.].

8. The golf ball according to claim 7, wherein $R^2$ is a divalent hydrocarbon group having 3 to 6 carbon atoms with a side chain.

9. The golf ball according to claim 1, wherein a mass ratio (hard polyol/soft polyol) of the hard polyol to the soft polyol falls within a range from 3/7 to 7/3.

10. The golf ball according to claim 1, wherein a mass ratio (hard polyol/soft polyol) of the hard polyol to the soft polyol falls within a range from 3/7 to 5/5.

11. The golf ball according to claim 1, wherein the polyisocyanate component is 4,4'-diphenylmethane diisocyanate.

12. The golf ball according to claim 1, wherein the cover has a hardness ranging from 20 to 50 in Shore D hardness.

13. The golf ball according to claim 1, wherein the polyol component has a number average molecular weight ranging from 400 to 10,000.

14. The golf ball according to claim 1, wherein the polyol component has a hydroxyl value (mgKOH/g) of 500 or less.

15. The golf ball according to claim 1, wherein a molar ratio (NCO/OH) of an isocyanate group contained in the polyisocyanate component to a hydroxyl group contained in the polyol component ranges from 1.00 to 1.10.

16. The golf ball according to claim 1, wherein the cover has a thickness ranging from 0.3 mm to 1.0 mm.

17. The golf ball according to claim 1, wherein the core has a hardness difference ranging from 10 to 40 in JIS-C hardness between a surface hardness and a center hardness thereof.

18. A golf ball comprising a core; and a cover covering the core and having a slab hardness ranging from 20 to 50 in Shore D hardness, wherein the cover contains, as a resin component, a polyurethane elastomer essentially consisting of a high-molecular weight polyol component having a number average molecular weight ranging from 400 to 10,000 and a polyisocyanate component;

wherein the high-molecular weight polyol component contains a hard polyol; and a soft polyol that does not have any one of a carbonate group, a ring structure, and an unsaturated bond in a main chain thereof, in a mass ratio of the hard polyol to the soft polyol being from 3/7 to 7/3, and wherein the hard polyol is a polycarbonate polyol represented by the following Formula (1):

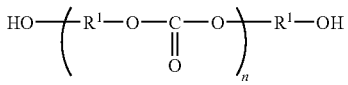

(1)

wherein $R^1$ denotes a divalent hydrocarbon group having an alicyclic structure or an aromatic ring structure in the main chain, and n denotes a natural number.

* * * * *